US009925819B2

(12) United States Patent
Kanematsu

(10) Patent No.: US 9,925,819 B2
(45) Date of Patent: Mar. 27, 2018

(54) POST PROCESS CONTROL APPARATUS, METHOD OF CONTROLLING THE SAME, SHEET PROCESSING SYSTEM, AND STORAGE MEDIUM

(71) Applicant: CANON KABUSHIKI KAISHA, Tokyo (JP)

(72) Inventor: Shinichi Kanematsu, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/015,293

(22) Filed: Feb. 4, 2016

(65) Prior Publication Data

US 2016/0243874 A1 Aug. 25, 2016

(30) Foreign Application Priority Data

Feb. 19, 2015 (JP) ..... 2015-031058

(51) Int. Cl.
*B42C 1/12* (2006.01)
*B41F 33/00* (2006.01)
(Continued)

(52) U.S. Cl.
CPC ..... *B42C 1/12* (2013.01); *B41F 13/60* (2013.01); *B41F 13/66* (2013.01);
(Continued)

(58) Field of Classification Search
CPC ..... B65H 45/00; B65H 45/04; B65H 45/12; B65H 45/18; B65H 31/02; B65H 39/10;
(Continued)

(56) References Cited

U.S. PATENT DOCUMENTS 6,421,523 B1 * 7/2002 Kondo ..... G03G 15/6547 270/58.3
6,868,253 B2 3/2005 Ueda et al.
(Continued)

FOREIGN PATENT DOCUMENTS

CN 101100249 A 1/2008
CN 102555427 A 7/2012
(Continued)

OTHER PUBLICATIONS

Search Report dated Jul. 8, 2016, in European Application No. 16000117.8.
(Continued)

*Primary Examiner* — David Banh
(74) *Attorney, Agent, or Firm* — Fitzpatrick, Cella, Harper & Scinto

(57) ABSTRACT

The present invention provides a post process control apparatus including a post processing unit configured to perform post processing on a printed sheet printed in accordance with a job, and a method for controlling the same, where the post process control apparatus and the method of controlling the same obtain a number of sheets in one copy of printed sheets instructed by the job, control the post processing unit to, if the obtained number of sheets in one copy is singular, execute the post processing in one batch on printed sheets corresponding to a plurality of copies, and to control the post processing unit to, if the obtained number of sheets in one copy is plural, execute the post processing individually by printed sheets corresponding to one copy.

7 Claims, 12 Drawing Sheets

(51) Int. Cl.

| | |
|---|---|
| ***B41F 13/60*** | (2006.01) |
| ***B41F 13/66*** | (2006.01) |
| ***B65H 45/18*** | (2006.01) |
| ***G03G 15/00*** | (2006.01) |
| ***B65H 31/02*** | (2006.01) |
| ***B65H 39/10*** | (2006.01) |
| ***B65H 43/00*** | (2006.01) |

(52) U.S. Cl.
CPC ..... *B41F 33/0009* (2013.01); *B65H 31/02* (2013.01); *B65H 39/10* (2013.01); *B65H 43/00* (2013.01); *B65H 45/18* (2013.01); *G03G 15/6544* (2013.01); *G03G 15/6582* (2013.01); *B65H 2301/1321* (2013.01); *B65H 2301/163* (2013.01); *B65H 2301/166* (2013.01); *B65H 2301/4213* (2013.01); *B65H 2301/42146* (2013.01); *B65H 2511/30* (2013.01); *B65H 2801/27* (2013.01); *G03G 2215/00831* (2013.01); *G03G 2215/00877* (2013.01)

(58) Field of Classification Search
CPC ..... B65H 43/00; B65H 2301/1321; B65H 2301/163; B65H 2301/4213; B65H 2301/42146; B65H 2511/30; B65H 2301/166; B42C 1/12; B41F 33/009; B41F 13/60; B41F 13/66; G03G 2215/00831; G03G 2215/00877; G03G 15/6582; G03G 15/6544
See application file for complete search history.

(56) References Cited

U.S. PATENT DOCUMENTS

| | | | | |
|---|---|---|---|---|
| 7,568,688 | B2 | 8/2009 | Nomura et al. | |
| 8,711,421 | B2 | 4/2014 | Katayama | |
| 2012/0205853 | A1* | 8/2012 | Nakamura | B65H 29/20 270/58.01 |
| 2012/0287455 | A1* | 11/2012 | Sawano | H04N 1/00015 358/1.13 |
| 2013/0328258 | A1 | 12/2013 | Mutsuno | |
| 2014/0133938 | A1* | 5/2014 | Tachibana | G03G 15/6544 412/6 |

FOREIGN PATENT DOCUMENTS

| | | | |
|---|---|---|---|
| CN | 102642741 | A | 8/2012 |
| CN | 102780827 | A | 11/2012 |
| CN | 103482402 | A | 1/2014 |
| EP | 1324147 | A2 | 7/2003 |
| EP | 1876123 | A2 | 1/2008 |
| EP | 2472388 | A2 | 7/2012 |
| JP | 2012-141668 | A | 7/2012 |

OTHER PUBLICATIONS

Office Action dated May 3, 2017, in Chinese Patent Application No. 201610083895.9.

* cited by examiner

POST PROCESS CONTROL APPARATUS, METHOD OF CONTROLLING THE SAME, SHEET PROCESSING SYSTEM, AND STORAGE MEDIUM

BACKGROUND OF THE INVENTION

Field of the Invention

The present invention relates to a post process control apparatus, a method of controlling a post process control apparatus, a sheet processing system, and storage medium.

Description of the Related Art

"Saddle stitching" in which after binding sheets that are respectively imposed for bookbinding, bookbinding is performed by folding in two is known. Also "center-folding bookbinding" in which bookbinding is performed by folding printed sheets that are respectively imposed for bookbinding in two without stitching them is known. In "saddle stitching" and "center-folding bookbinding", a plurality of sheets are bundled, and folding processing or bookbinding processing is performed. Meanwhile, "non-bookbinding center-folding" in which sheets that are not imposed for bookbinding are folded in two is known. If such "non-bookbinding center-folding" processing is performed, in order to make it easy to recognize a separation of copies in a printed sheet bundle, bundling a plurality of sheets that configure a copy, and folding them collectively is typical. Furthermore, in Japanese Patent Laid-Open No. 2012-141668 it is recited that an inter leaf is inserted between copies of printed sheet bundles in order to make it easy to recognize a separation of copies.

However, in the foregoing conventional technique, in a case where the number of sheets in 1 copy is one, for example, the effort to find the separation between copies does not exist in the first place. In spite of this, each sheet is folded dividing by each copy, that is, the folding processing for each single sheet takes time, and there is a problem in that productivity is worsened.

SUMMARY OF THE INVENTION

An aspect of the present invention is to eliminate the above-mentioned problems with conventional technology.

According to a first aspect of the present invention, there is provided a post process control apparatus, comprising: a post processing unit configured to perform post processing on a printed sheet printed in accordance with a job; an obtaining unit configured to obtain a number of sheets in one copy of printed sheets instructed by the job; and a control unit configured to control the post processing unit to: (i) if the number of sheets in one copy obtained by the obtaining unit is singular, execute the post processing in one batch on printed sheets corresponding to a plurality of copies, and (ii) if the number of sheets in one copy obtained by the obtaining unit is plural, execute the post processing individually by printed sheets corresponding to one copy.

According to a second aspect of the present invention, there is provided a sheet processing system including a printing apparatus, and a post process control apparatus that receives a sheet printed by the printing apparatus and performs post processing on the sheet, wherein the printing apparatus comprising: a conveyance unit configured to discharge and to convey to the post process control apparatus a sheet printed in accordance with a job, and wherein the post process control apparatus comprises: a post processing unit configured to perform post processing on a printed sheet that is conveyed by the conveyance unit; an obtaining unit configured to obtain a number of sheets in one copy of printed sheets instructed by the job; a control unit configured to control the post processing unit to: (i) if the number of sheets in one copy obtained by the obtaining unit is singular, execute the post processing in one batch on printed sheets corresponding to a plurality of copies, and (ii) if the number of sheets in one copy obtained by the obtaining unit is plural, execute the post processing individually by printed sheets corresponding to one copy.

According to a third aspect of the present invention, there is provided a method of controlling a post process control apparatus, the method comprising: performing post processing on a printed sheet printed in accordance with a job; obtaining a number of sheets in one copy of printed sheets instructed by the job; controlling to, if the obtained number of sheets in one copy is singular, execute the post processing in one batch on printed sheets corresponding to a plurality of copies, and controlling to, if the obtained number of sheets in one copy is plural, execute the post processing individually by printed sheets corresponding to one copy.

Further features of the present invention will become apparent from the following description of exemplary embodiments with reference to the attached drawings.

BRIEF DESCRIPTION OF THE DRAWINGS

The accompanying drawings, which are incorporated in and constitute a part of the specification, illustrate embodiments of the invention and, together with the description, serve to explain the principles of the invention.

DESCRIPTION OF THE EMBODIMENTS

Embodiments of the present invention will be described hereinafter in detail, with reference to the accompanying drawings. It is to be understood that the following embodiments are not intended to limit the claims of the present invention, and that not all of the combinations of the aspects that are described according to the following embodiments are necessarily required with respect to the means to solve the problems according to the present invention.

Note, explanation is given using an example of an image forming apparatus to which a finishing apparatus is connected, and which discharges printed sheets to the finishing apparatus, and which causes the finishing apparatus to execute folding processing as an example of post processing, as an example of a post process control apparatus according to the present invention. However, the present invention is not limited such a configuration; the present invention may be a stand-alone post process control apparatus such as, for example, a bookbinding apparatus, or may be a control apparatus that is connected to a post process control apparatus and that controls operation of the post process control apparatus. Also, the present invention can be applied to a sheet processing system including an image forming apparatus (a printing apparatus) 100 and a finishing apparatus (a post process control apparatus) according to the embodiment.

Figure 1:
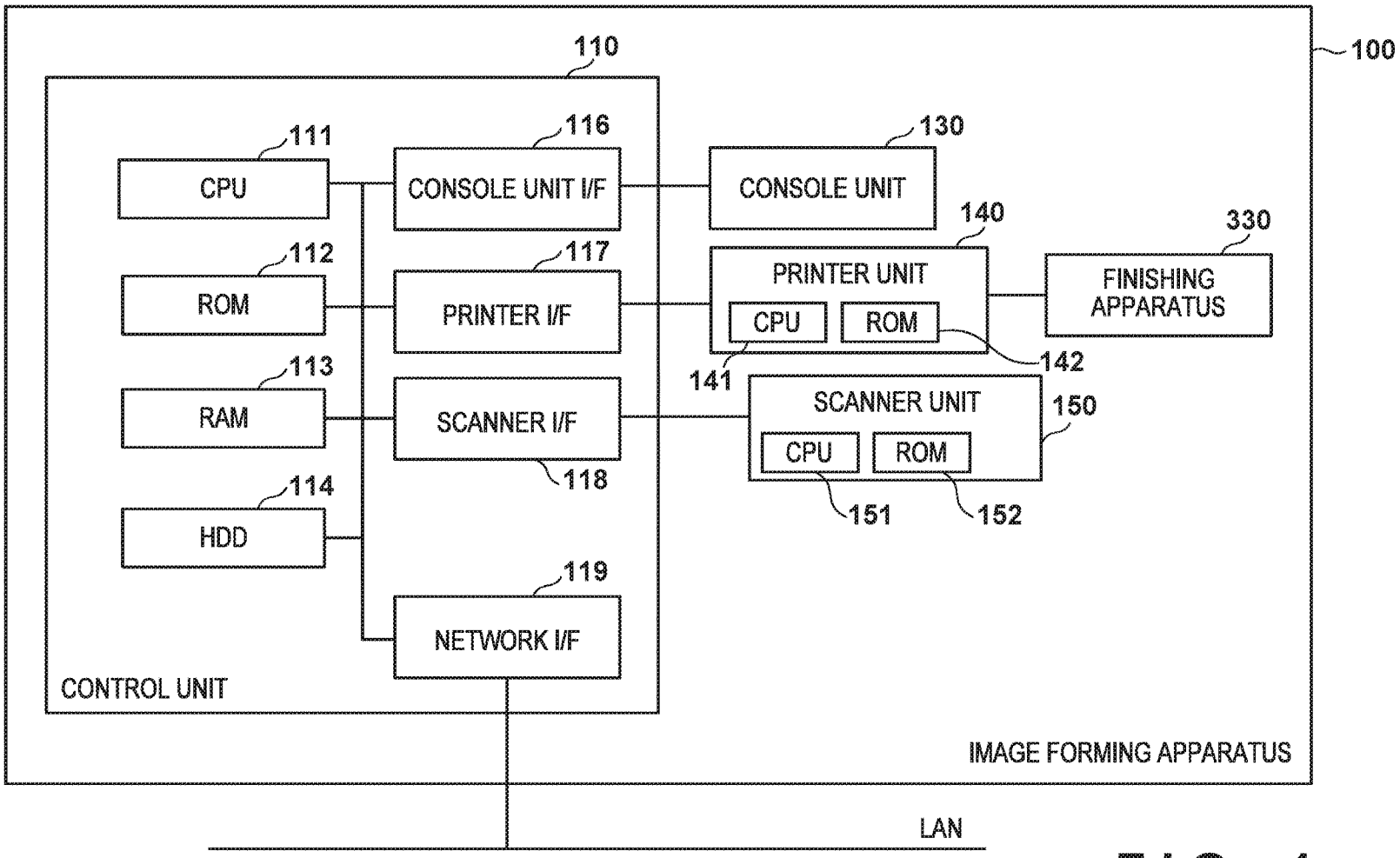
FIG. 1 is a block diagram for explaining a hardware configuration of an image forming apparatus according to an embodiment of present invention.

FIG. 1 is a block diagram for explaining a hardware configuration of the image forming apparatus 100 according to the embodiment of present invention.

A control unit 110 controls operation of the image forming apparatus 100 on the whole. For this, the control unit 110 comprises a configuration explained below. A CPU 111 executes various control processing explained later by deploying programs for the control unit 110 stored in a ROM 112 into a RAM 113 and executing them. Programs executed by the CPU 111 includes an application program for scanning. Then, by executing the application program for scanning, an image of an original is read by a scanner unit 150 and image data of the original is generated. Then, the CPU 111 stores the generated image data in an HDD 114. A console unit I/F 116 transfers an instruction inputted by a user using a console unit 130 to the CPU 111. Also, the console unit I/F 116 receives data to be displayed on the console unit 130 from the CPU 111 and transfers it to the console unit 130. Note, the console unit 130 comprises a display unit (Graphical User Interface, GUI hereinafter) comprising a touch panel function or a keyboard, and accepts a user instruction. A printer I/F 117 is an interface for connecting the control unit 110 to a printer unit 140. Here, the printer unit 140 prints on a recording medium such as paper (a sheet) based on image data transferred from the control unit 110 via the printer I/F 117. Also, the printer unit 140 controls a finishing apparatus 330 for performing finishing processing of a printed sheet. A scanner I/F 118 is an interface for connecting the control unit 110 to the scanner unit 150. Here, the scanner unit 150 generates image data by reading an image of an original using a line sensor or the like. Then, the scanner unit 150 transmits the generated image data to the control unit 110 through the scanner I/F 118. In this way, the image data stored in the HDD 114 is printed by the printer unit 140. Also, a copy operation can be performed by the printer unit 140 printing the image data generated by the scanner unit 150. A network I/F 119 connects the image forming apparatus 100 and a LAN, receives print data transmitted from a PC (not shown) or the like connected to the LAN, and executes printing.

Here, the printer unit 140 and the scanner unit 150 respectively comprise CPUs 141 and 151 and ROMs 142 and 152 for storing control programs of each corresponding CPU. Here, by the CPUs 141 and 151 reading and executing programs stored in the corresponding ROMs 142 and 152 respectively, it is possible to perform operations of the printer unit 140 and the scanner unit 150, and communication with the control unit 110.

Next, explanation is given for a functional configuration of software executed by the CPU 111 of the control unit 110 in the image forming apparatus 100 according to the embodiment.

Figure 2:
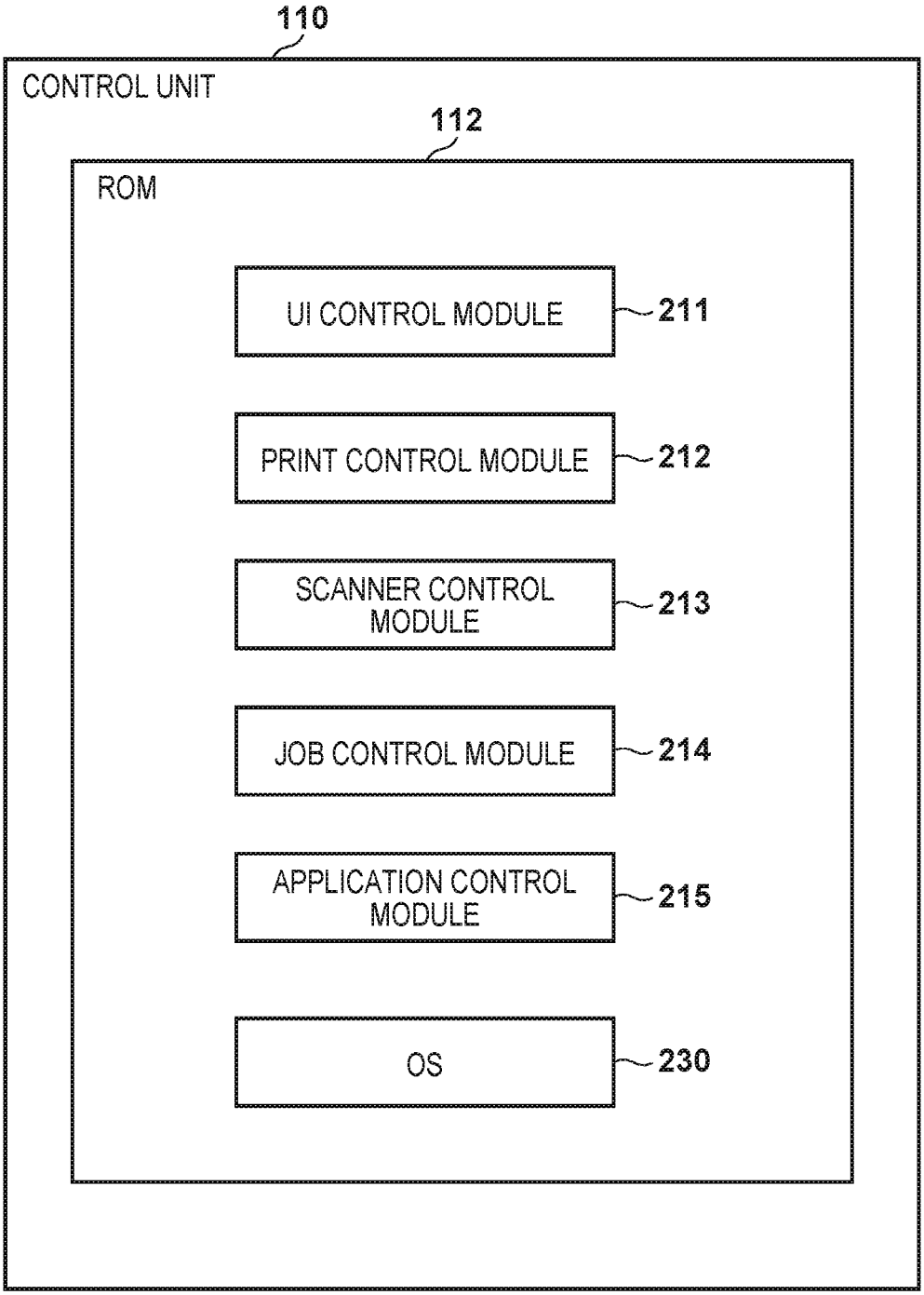
FIG. 2 is a functional block diagram for explaining functions of a control unit of the image forming apparatus according to the embodiment.

FIG. 2 is a functional block diagram for explaining functions of the control unit 110 of the image forming apparatus 100 according to the embodiment. Note, each function illustrated in FIG. 2 is achieved by the CPU 111 executing the program stored in the ROM 112.

A UI control module 211 controls the console unit 130 through the console unit I/F 116. Similarly, a print control module 212 controls the printer unit 140 and the finishing apparatus 330 through the printer I/F 117. A scanner control module 213 controls the scanner unit 150 through the scanner I/F 118. A job control module 214 interprets a job setting accepted from the network I/F 119 or the console unit 130 and transfers to the print control module 212 imposition processing for printing on a sheet or finishing information. An application control module 215 implements various functions of the image forming apparatus 100. An OS 230 is an operating system for controlling execution of programs that implement the functions corresponding to each unit described above.

Figure 3A:
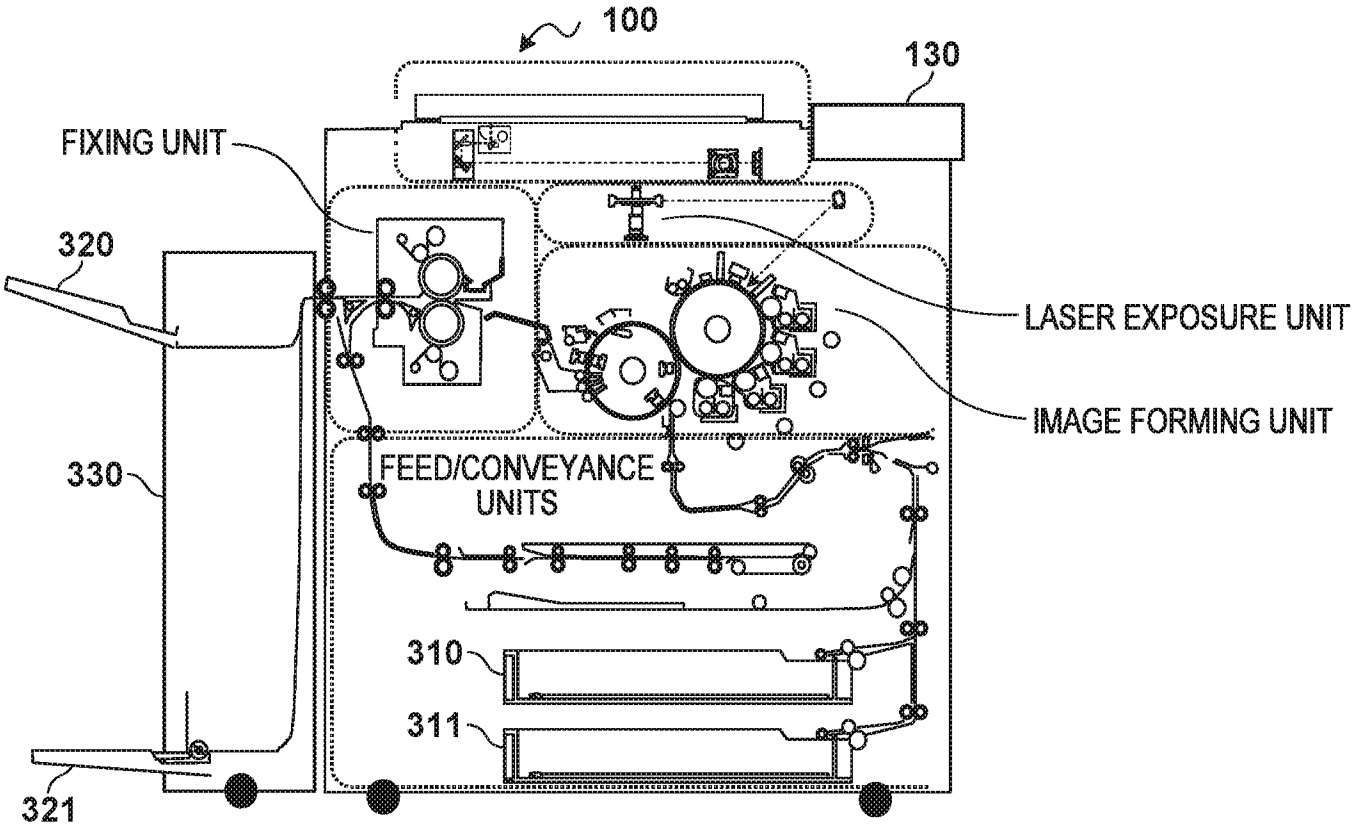
FIG. 3A depicts a structural cross-section view of the image forming apparatus according to the embodiment from a perspective of a front surface.
Figure 3B:
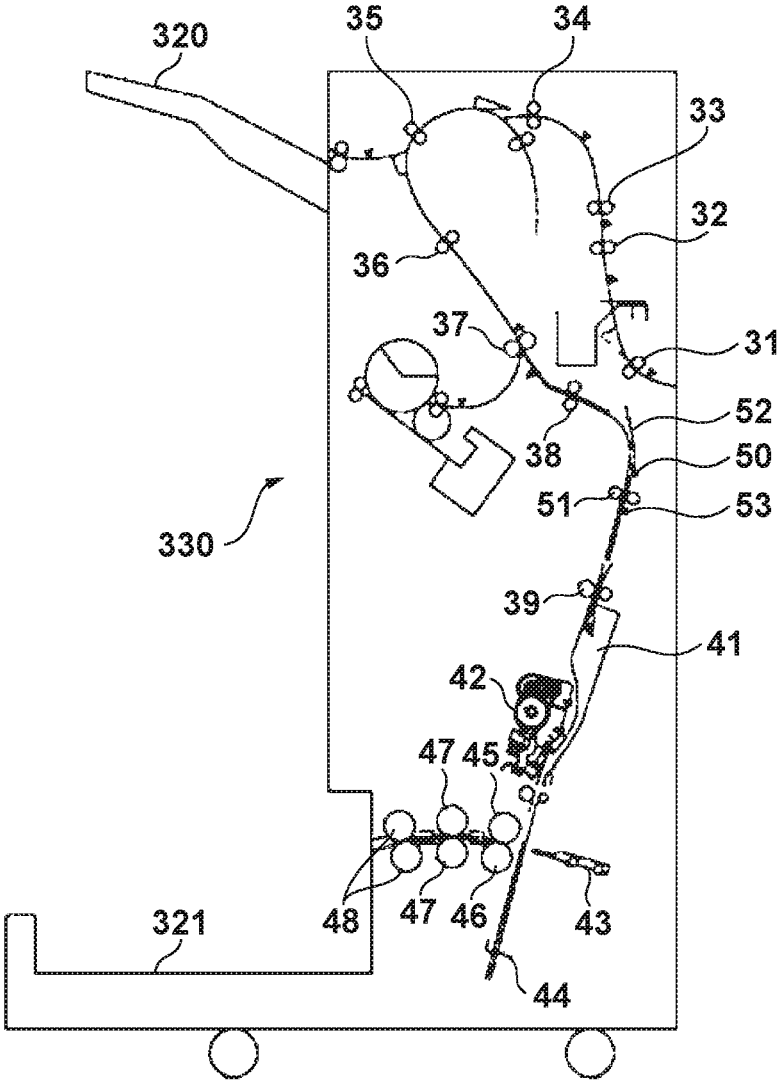
FIG. 3B depicts a structural cross-section view of a finishing apparatus according to the embodiment from a perspective of a side face.

FIG. 3A and FIG. 3B depict views for explaining a configuration of the image forming apparatus 100 according to the embodiment; FIG. 3A depicts a structural cross-section view from a perspective of a front surface; and FIG. 3B depicts a structural cross-section view from a perspective of a side face of the finishing apparatus 330.

In FIG. 3A, a sheet is stacked on a paper feed cassette 310 or a paper feed cassette 311, and is conveyed into the apparatus by a feed/conveyance unit. An image is formed on the conveyed sheet via an image forming unit and a fixing unit of the printer unit 140, and the sheet on which an image has been formed is discharged via the finishing apparatus 330. The finishing apparatus 330 is equipped with a discharge tray 320 and a discharge tray 321, and the discharge tray 321 receives a printed sheet to which binding saddle stitching or non-bookbinding saddle stitching processing is performed. Note, the maximum number at which center-folding can be executed in the finishing apparatus 330 according to this embodiment is set to 3.

Next, a configuration of the finishing apparatus 330 is explained with reference to FIG. 3B.

The finishing apparatus 330 comprises conveyance rollers 31-39, leading edge detection sensors 50 and 53, a stapler 42, a push member 43, a stopper 44, folding rollers 45 and 46, bundle conveyance roller pair 47 and 48, and the discharge trays 320 and 321. The finishing apparatus 330 may be operated by a command from the control unit 110 of the image forming apparatus 100 or may be operated by an independent controller.

Printed sheets conveyed from the image forming apparatus 100 are discharged to one of the discharge trays 320 and 321 in accordance with the type of the sheet processing set by the user. For example, in a case where the sheet processing is not executed, the printed sheets are discharged to the discharge tray 320. On the other hand, in a case where saddle stitching processing or center-folding processing is executed, the sheets (a sheet bundle) to which these processes have been performed are discharged to the discharge tray 321. The printed sheets conveyed from the image forming apparatus 100 are conveyed by the conveyance rollers 31-38 until the leading edge of the sheet reaches the position of the leading edge detection sensor 50. Then, if the leading edge of the sheet is detected by the leading edge detection sensor 50, the rotating speed of the conveyance roller 38 pinching the sheet is decelerated, and the leading edge of the sheet is caused to collide with a nip of a skew correction roller 51. In this way, the conveyance roller 38 continues to rotate for a time after the leading edge of the sheet collides with the nip of the skew correction roller 51. Then, the rotation of the conveyance roller 38 is stopped after the sheet forms a loop in a loop space 52. Next, the skew correction roller 51 starts rotating. In a case where the sheet is skewed, the skew of the sheet is corrected by the skew correction roller 51. Also a sheet whose skew is corrected is conveyed to a direction of the conveyance roller 39. When the leading edge of the sheet is detected by the leading edge detection sensor 53 in this way, the sheet is conveyed a predetermined amount from that point in time, and the leading edge of the sheet is caused to collide with the stopper 44. In this case, the sheet is positioned by the stopper 44 so that a position for binding by the stapler 42 comes to the central portion of the sheet. By repeating the above described operation, a plurality of sheets are conveyed to a conveying path 41 sequentially.

In this way, when all of the sheets constituting a book are conveyed to the conveying path 41, positions in the widthwise direction of these sheets are aligned by a widthwise direction alignment plate (not shown), and a later described sheet bundle is formed within the conveying path 41. At this point, the sheets which are conveyed in the conveying path 41 are conveyed sequentially in order from the sheet positioned innermost in the book.

Then, in a case where it is set to perform the saddle stitching processing, the stapler 42 performs the binding processing to the central portion of the sheet bundle. When the sheet bundle is bound by the stapler 42, the stopper 44 supporting the sheet bundle moves towards a downstream side of the conveyance direction, and the sheet bundle moves downstream in the conveyance direction.

Meanwhile, in a case where it is not set to perform the saddle stitching processing and it is set to perform the center-folding processing (also called saddle folding processing), the stapling processing by the stapler 42 is omitted. The stopper 44 performs positioning of the sheet bundle so that the central portion of the sheet bundle comes to the position of the push member 43. Then, the leading edge of the push member 43 abuts a portion at which a fold of the sheet bundle positioned by the stopper 44 is formed, and the sheet bundle is pressed to the nip of the folding rollers 45 and 46, to form the fold on sheets of the sheet bundle. In this way, the sheet bundle to which the fold is formed by the folding rollers 45 and 46 is discharged to the discharge tray 321 by the rotation of the bundle conveyance roller pair 47 and 48.

Figure 11A:
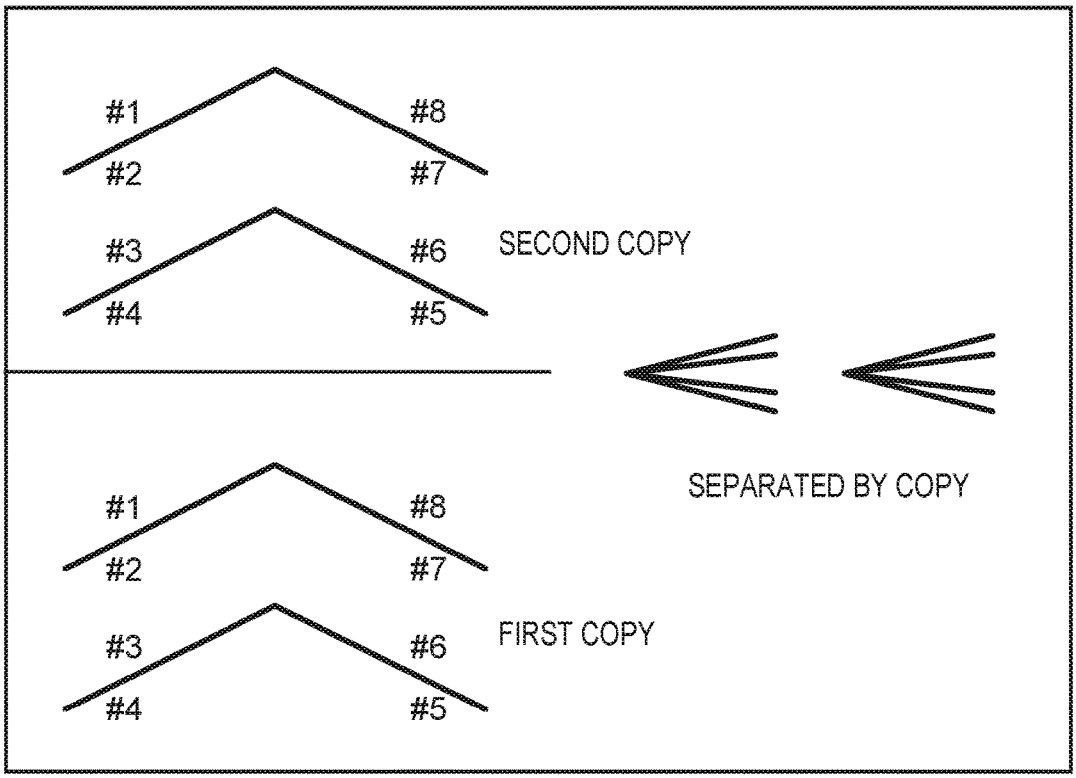
FIG. 11A depicts a view for explaining an example of an output imposition and a finished bundle for "binding saddle stitching".
Figure 11B:
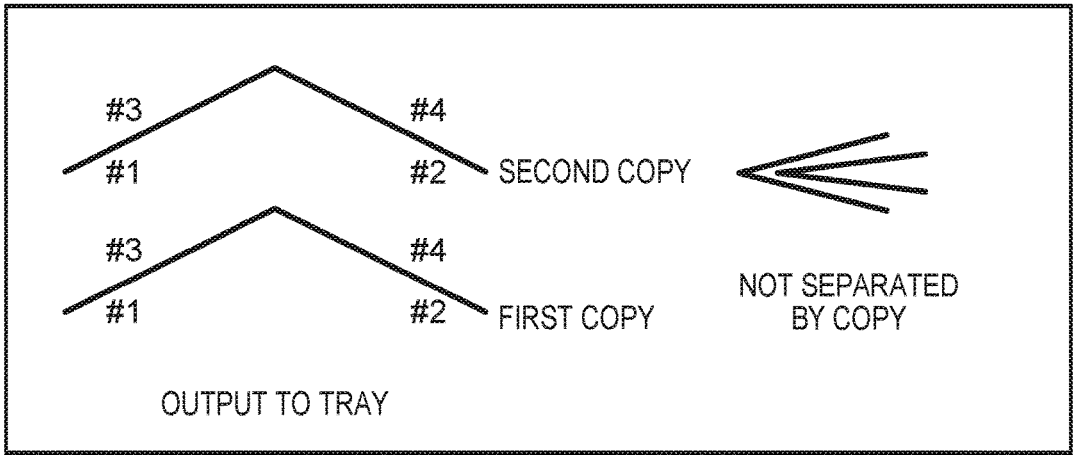
FIG. 11B depicts a view for explaining an example of an output imposition for "non-bookbinding center-folding".

Here, explanation is given for "binding saddle stitching" and "non-bookbinding center-folding" with reference to FIGS. 11A and 11B. Note, in FIGS. 11A and 11B, illustrated numerals to which # is added indicate page numbers of the originals.

FIG. 11A depicts a view illustrating an example of the output imposition and finished bundles of "binding saddle stitching"; here an example illustrates a case where 1 copy is configured by 8 pages of originals, and 2 bookbinding products consisting of 2 double-sided printed sheet bundle copies of these originals are formed. For "bookbinding saddle stitching", imposition to both sides of each sheet and saddle stitching of the sheets are performed so that the printed sheets are bound in a state in which they are folded in 2. Furthermore, in bookbinding imposition, finishing processing is performed at a separation of copies, and finishing processing is performed so that the separation of copies is clear.

FIG. 11B depicts a view illustrating an example of the output imposition of "non-bookbinding center-folding", where 1 copy is configured by 4 pages of originals and 2 sheets corresponding to 2 copies of sheets are outputted. Here, the separation of the copies is every 1 sheet, because "non-bookbinding center-folding" is set and the number of sheets per 1 copy to which the double-sided printing of these originals is performed is 1. Because center-folding finishing takes time here, an example in which productivity can be improved by performing sheet folding finishing collectively with the maximum number of sheets for the folding capability of the center-folding apparatus is illustrated. In other words, in a case where the maximum number of sheets for center-folding in the finishing apparatus 330 is 3, folding processing is performed for the 2 sheets collectively without separating sheets by copy, because the folding finishing can be performed on 2 sheets collectively.

Next, explanation is given for an example of a setting of a copy job and a finishing operation according to this embodiment.

Figure 7A:
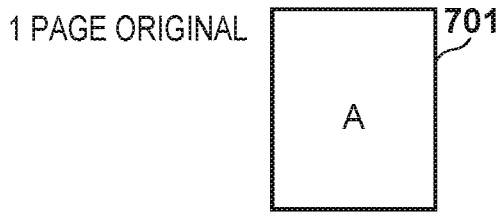
FIGS. 7A to 7C depict views for explaining a state of an original, printed sheets, and after finishing when a single sheet original is copied with a copy number of 3, and "non-bookbinding center-folding" finishing is executed.
Figure 7B:
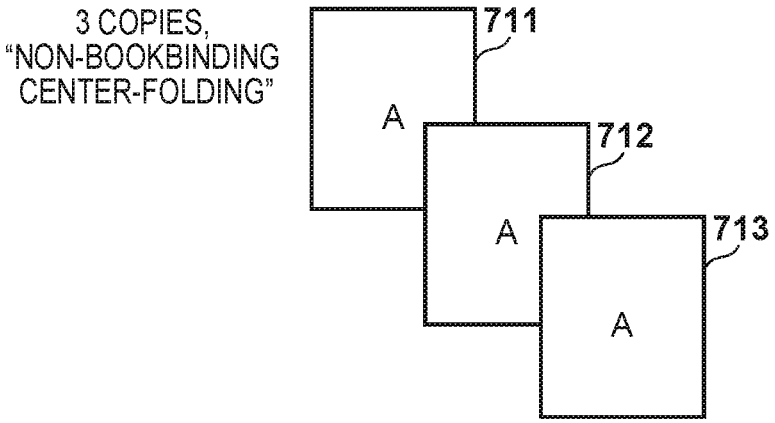
Figure 7C:
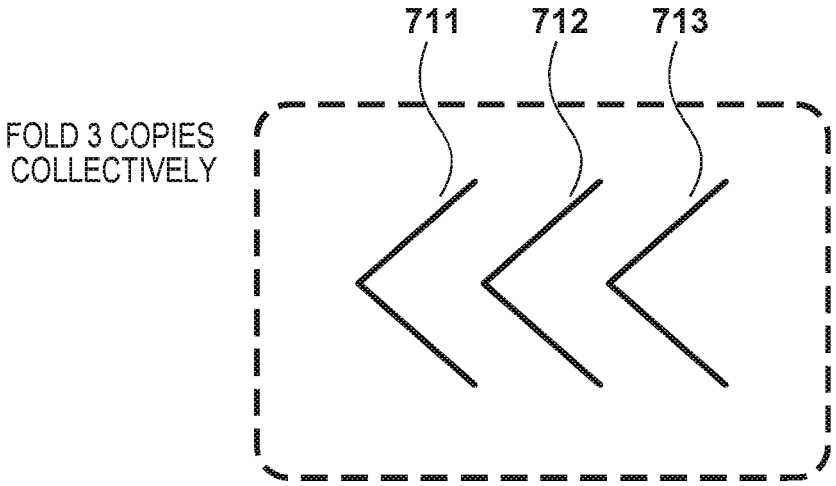

FIGS. 7A through 7C depict views for explaining a state of an original, printed sheets, and after finishing when a single sheet original is copied with a copy number of 3, and "non-bookbinding center-folding" finishing is executed.

In FIG. 7A, an original 701 illustrates a 1 page original. 711-713 in FIG. 7B illustrate printed sheets obtained as a result of copying the original 701 into 3 single-sided copies (1 sheet for 1 copy). FIG. 7C illustrates the result of "non-bookbinding center-folding" finishing being performed on sheets 711-713. Here, the center-folding processing is performed on 3 copies (3 sheets) corresponding to the above described maximum number of sheets for center-folding collectively.

Figure 8A:
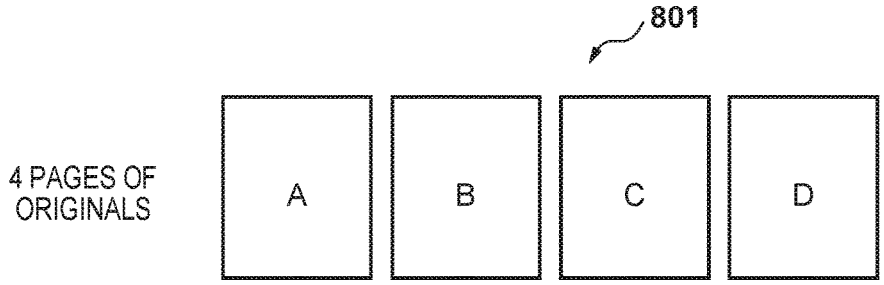
FIGS. 8A to 8C depict views for explaining a state of originals, printed sheets, and after finishing when four originals are copied with a copy number of 3, and "non-bookbinding center-folding" finishing is executed.
Figure 8B:
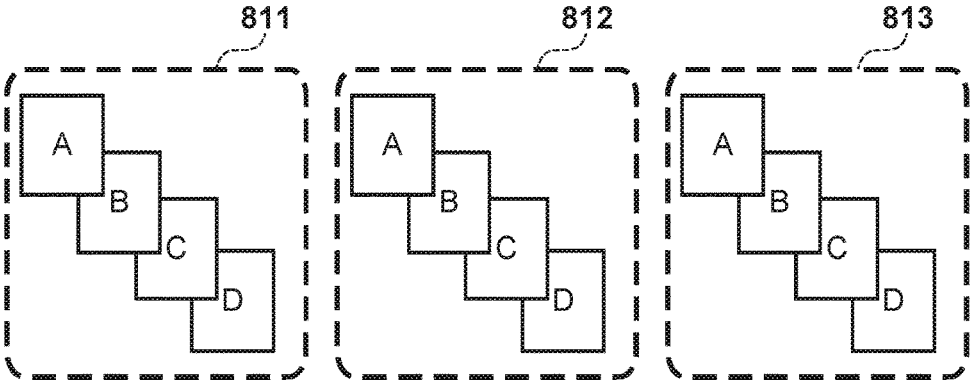
Figure 8C:
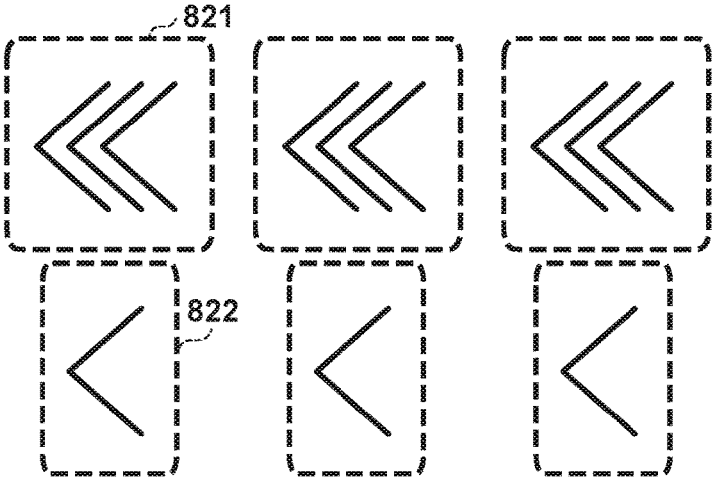

FIGS. 8A through 8C depict views for explaining a state of originals, printed sheets, and after finishing when four originals are copied with a copy number of 3, and "non-bookbinding center-folding" finishing is executed.

In FIGS. 8A and 8B, the result of 3 copies of the single-sided printing of 4 originals 801 is illustrated in reference numerals 811 through to 813. Here, printed sheets obtained as a result of 3 copies of single-sided copying of the originals 801 which consist of 4 pages are illustrated. FIG. 8C illustrates the result of "non-bookbinding center-folding" finishing being performed on sheets of 3 copies 811 through to 813. Here, the maximum number of sheets for the folding capability of the finishing apparatus is set to 3. Accordingly, non-bookbinding center-folding is executed on the first 3 printed sheets of the first copy 811, and a finished bundle 821 is outputted. Then, after the fourth sheet of the first copy 811 is printed, it is determined that the fourth sheet is a separation of the first copy 811, non-bookbinding center-folding is executed on the fourth sheet, and a finished product 822 is outputted. In this way, in a case where the number of sheets of 1 copy is more than the maximum number of sheets for folding capability, the center-folding processing is executed a plurality of times for 1 copy. The center-folding processing is executed similarly on the remaining 2 copies of printed sheets. Note, for example as illustrated by 822, the folding processing is not performed together with the sheets of the next copy. This is to make clear the separation of copies by performing the folding processing for every copy separately.

Next, finishing processing according to this embodiment is explained with reference to flowcharts in FIGS. 4 through 6.

Figure 4:
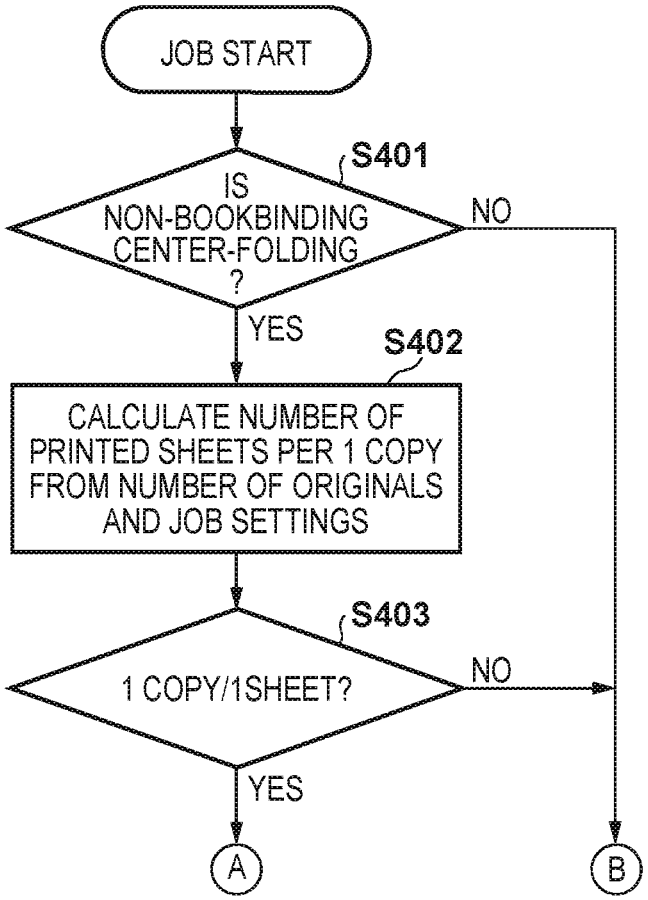
FIGS. 4 through 6 are flowcharts for describing center-folding processing in which the finishing apparatus is controlled by the image forming apparatus according to a first embodiment.
Figure 5:
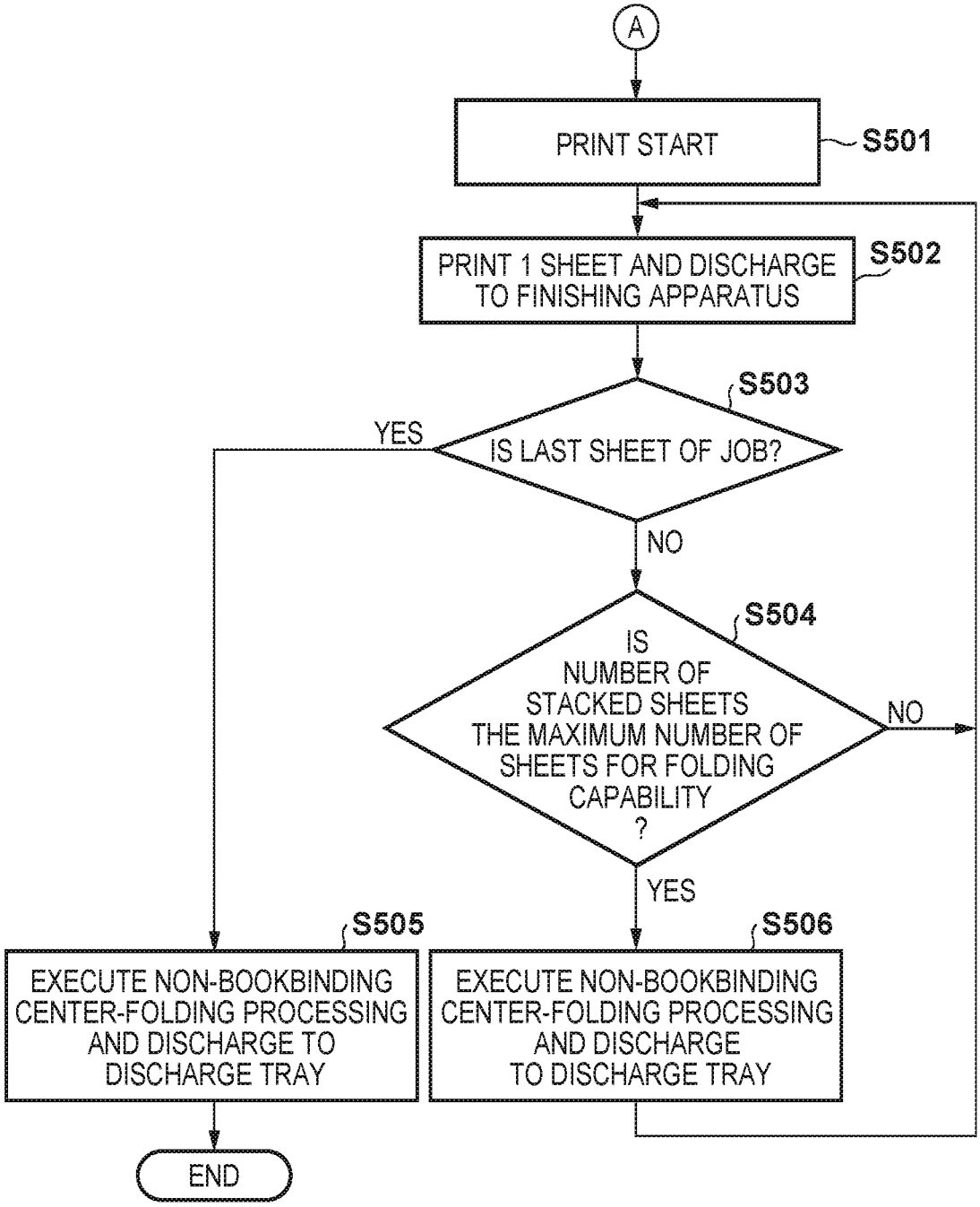
Figure 6:
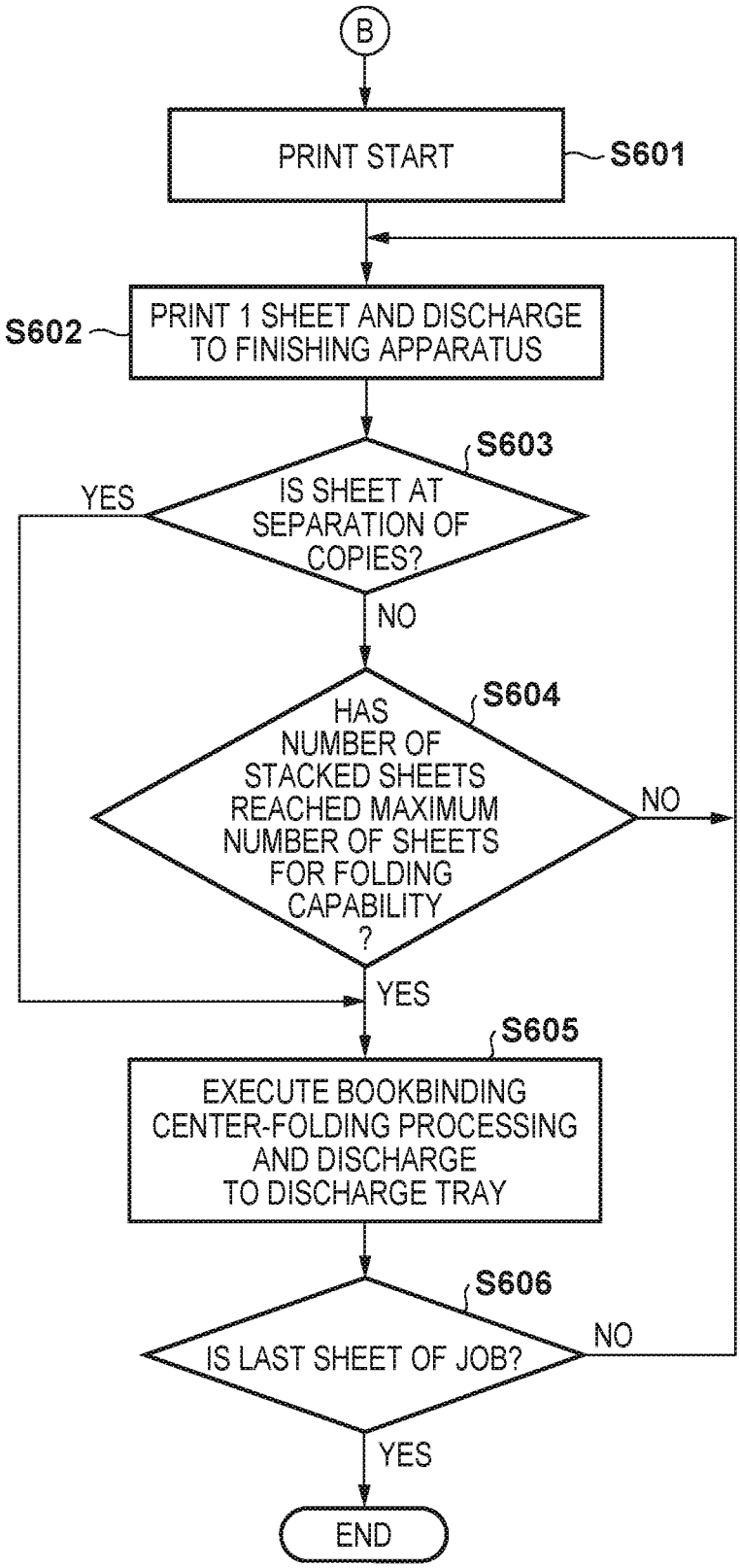

FIGS. 4 through 6 are flowcharts for describing center-folding processing by which the finishing apparatus 330 is controlled by the image forming apparatus 100 according to a first embodiment. Processing illustrated by the flowcharts is achieved by the CPU 111 deploying a program stored in the ROM 112 into the RAM 113 and executing it.

This process is started by the CPU 111 receiving information of a job setting and a copy start operation from, for example, the console unit 130, and starting job execution based on the job information. Upon the job execution, the CPU 111 functions as the job control module 214 to execute the job.

Firstly, the CPU 111 interprets the received job setting, and functioning as the scanner control module 213 and the print control module 212, starts an operation in accordance with the job setting in step S401 based on the job setting. Then, it is determined in step S401 whether or not a setting for "non-bookbinding center-folding" is included in the job setting. In a case where "non-bookbinding center-folding" is not set, the processing proceeds to step S601 in FIG. 6, operation is performed so that printed sheets are separated at the separation of copies of printed sheets, and then finishing processing is performed. The explanation of the flowchart in FIG. 6 is described later.

In a case where "non-bookbinding center-folding" is set in step S401, the processing proceeds to step S402, and the CPU 111 obtains the number of sheets per 1 copy based on the number of sheets of originals, image imposition, and setting as to whether or not double-sided printing is performed. Next, the processing proceeds to step S403, the CPU 111 determines whether the number of sheets per 1 copy is 1 (singular) or plural. Here, in a case where the number of sheets per 1 copy is plural, the processing proceeds to step S601 in FIG. 6 as previously described, and in a case where the number of sheets per 1 copy is 1, the processing proceeds to step S501 in FIG. 5.

Next, explanation is given with reference to the flowchart in FIG. 5.

In step S501 of FIG. 5, the CPU 111 functions as the print control module 212 and starts print processing. Next, the processing proceeds to step S502, the CPU 111 performs printing of the first sheet, and by conveying of the printed first sheet to the finishing apparatus 330, causes it to be held in the conveying path 41. Next the processing proceeds to step S503, and the CPU 111 determines whether or not it is the last printed sheet of the executing job. Here, for example in a case of the job explained in FIGS. 7A-7C, the original 701 is 1 page and the number of print copies is 3, so the processing proceeds to step S504. In step S504, the CPU 111 determines whether or not the number of printed sheets held in the current conveying path 41 has reached the maximum number of sheets for the folding capability of the finishing apparatus 330. Here, if the number is determined not to reach the maximum number of sheets for the folding capability, the processing proceeds to step S502 and printing is performed on the next sheet. Also, if the number is determined to reach the maximum number of sheets for the folding capability in step S504, the processing proceeds to step S506, the CPU 111 causes the finishing apparatus 330 to execute non-bookbinding center-folding processing, the sheets on which the folding processing has been executed are discharged to the discharge tray 321, and the processing proceeds to step S502.

Then, when, in step S503, the CPU 111 determines that it is the final printed sheet of the executing job, the processing proceeds to step S505, non-bookbinding center-folding processing is caused to be executed on one or more sheets held in the current conveying path 41 by the finishing apparatus 330, the sheets on which the folding processing has been executed are discharged to the discharge tray 321, and the processing terminates.

For example, in the example of FIGS. 7A-7C, because the first and second sheets are not the final sheet of the job and because the maximum number of sheets of the folding capability is not reached, the processing from step S504 to step S502 to step S503 is repeated. Then, at the point in time of printing to the third sheet, it is determined that the sheet is the final sheet of the job in step S503, the processing proceeds to step S505, and non-bookbinding center-folding is executed as shown in FIG. 7C.

In this way, as is illustrated in FIG. 7C, if 1 copy is comprised by 1 sheet, folding processing is performed collectively for the number of sheets (the number of copies 3) corresponding to the maximum number of sheets of the folding capability. That is, folding processing is executed in one batch on sheets corresponding to a plurality of copies.

Next, explanation is given of a case in which a job, in which there are 4 pages of originals, and the number of copies is 3, is executed, as shown in FIGS. 8A-8C.

In such a case, the CPU 111, in step S403 of FIG. 4, determines that it is not a 1 copy/1 sheet job, and advances the processing to step S601 of FIG. 6. In step S601 of FIG. 6, the CPU 111 functions as the print control module 212 and starts print processing. Next, the processing proceeds to step S602, the CPU 111 performs printing of the first sheet, and by conveying of the printed first sheet to the finishing apparatus 330, causes it to be held in the conveying path 41. Next, the processing proceeds to step S603, the CPU 111 determines whether or not the sheet is at the separation of copies; if it is not at a separation of copies, the processing proceeds to step S604; if it is at a separation of copies, the processing proceeds to step S605, and folding processing is caused to be executed on the sheet bundle held in the conveying path 41 by the finishing apparatus 330. Meanwhile, in step S604, the CPU 111 determines whether or not the number of sheets held in the conveying path 41 has reached the maximum number of sheets for the folding capability of the finishing apparatus 330. Note that the number of sheets held in the conveying path 41 is counted by a counter arranged in the RAM 113. Here, if the CPU 111 determines that the number of sheets held in the conveying path 41 does not reach the maximum number of sheets for the folding capability of the finishing apparatus 330, the processing proceeds to step S602, and the next sheet is printed.

In this way, in step S604, when it is determined that the number of sheets held reaches the maximum number of sheets for the folding capability of the finishing apparatus 330, the processing proceeds to step S605. In step S605, the CPU 111 controls the finishing apparatus 330 to cause folding processing to be executed on the sheet bundle held in the conveying path 41, and the processing proceeds to step S606. In step S606, the CPU 111 determines whether or not the final printed sheet of the executing job is determined, and if not, the processing proceeds to step S602, and printing of the next sheet is executed. The non-bookbinding center-folding processing is caused to be executed by the finishing apparatus 330, the sheets on which the folding processing is executed are discharged to the discharge tray 321, and the processing terminates.

A concrete example of processing by the flowchart of FIG. 6 is explained with reference to FIGS. 8A through 8C.

The setting of the job in FIGS. 8A-8C is to use 4 originals 801, where the number of copies is 3, and finishing is "non-bookbinding center-folding". Accordingly, the processing proceeds to step S601 of FIG. 6 from step S403 of FIG. 4. Then, after printing to the third sheet of the first copy, the CPU 111, in step S604, determines that the maximum number of sheets for the folding capability is reached, the processing proceeds to step S605, the center-folding bookbinding is executed as shown 821 in FIG. 8C, and the finished bundle 821 is discharged to the discharge tray 321. Then, the processing proceeds to step S606. Here, because there is a subsequent page, the processing proceeds to step S602, the 4th sheet of the first copy is printed, and discharged to the finishing apparatus 330. Here, in step S603, the CPU 111 determines that the 4th sheet is the separation of the first copy, the processing proceeds to step S605, the non-bookbinding center-folding is caused to be executed by the finishing apparatus 330 as shown 822 in FIG. 8C, and the finished product 822 is discharged to the discharge tray 321. Thereafter, in the second copy and the third copy, similar processing is performed to execute the folding processing illustrated in FIG. 8C. In other words, if 1 copy is comprised by a plurality of sheets, post processing is executed individually by the sheets corresponding to 1 copy.

Figure 9A:
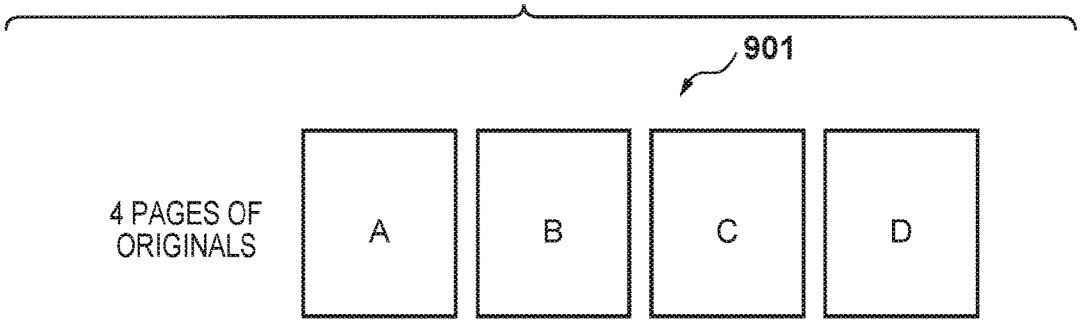
FIGS. 9A and 9B depict views for explaining a state of originals, printed sheets, and after finishing when four originals are copied into 3 4-in-1 copies, and "non-bookbinding center-folding" finishing is executed.
Figure 9B:
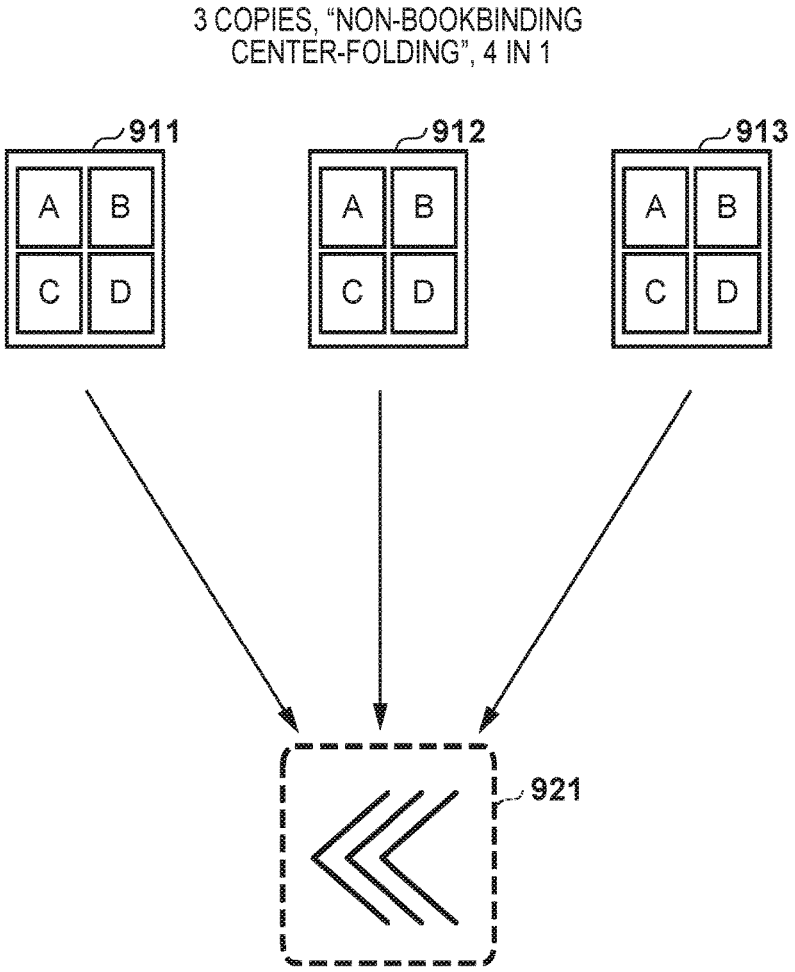

Next, with reference to FIGS. 9A and 9B, explanation is given for an example in which 3 copies of 4 originals are copied in a 4-in-1, and the center-folding processing is performed.

FIGS. 9A and 9B depict views for explaining a state of originals, printed sheets, and after finishing when four originals are copied into 3 4-in-1 copies, and "non-bookbinding center-folding" finishing is executed.

The result of printing 3 4-in-1 copies of 4 sheets of originals 901 illustrated in FIG. 9A is illustrated by reference numerals 911-913 of FIG. 9B. Furthermore, FIG. 9B illustrates the result of "non-bookbinding center-folding" finishing being performed on sheets 911-913 as a finished bundle 921. Here, because the number is 3 which is the maximum number of sheets for the folding capability of the finishing apparatus 330, the processing terminates after a single folding process.

Next, explanation is given of the flow of this processing in accordance with the flowcharts of FIG. 4 and FIG. 5.

In the case of this job, the CPU 111, in step S403 of FIG. 4, determines that the number of sheets for 1 copy is 1 sheet, and advances the processing to step S501 of FIG. 5. In step S502, 1 sheet is printed in a 3 4-in-1, and in step S503 and in step S504, because the sheet is not the final sheet of the job, and because the number of sheets is not the maximum for the folding capability, the processing proceeds to step S502. In this way, when the printed sheets 911-913 of FIG. 9B, by steps S502 through S504, are held in the conveying path 41 of the finishing apparatus 330, the processing proceeds to step S506 from step S504. In step S506, the CPU 111 causes the folding finishing to be executed collectively on these 3 sheets 911-913 by the finishing apparatus 330. In this way, the finished bundle 921 of the non-bookbinding center-folding as is illustrated in FIG. 9B is generated, and discharged to the discharge tray 321.

Figure 10A:
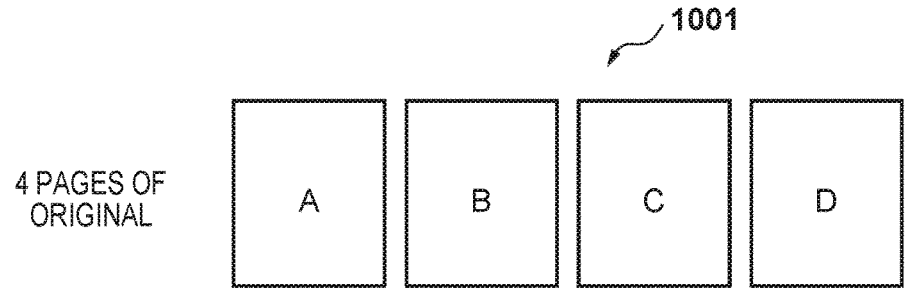
FIGS. 10A and 10B depict views for explaining a state of originals, printed sheets, and after finishing when four originals are copied into 3 4-in-1 copies, and "center-folding bookbinding" finishing is executed.
Figure 10B:
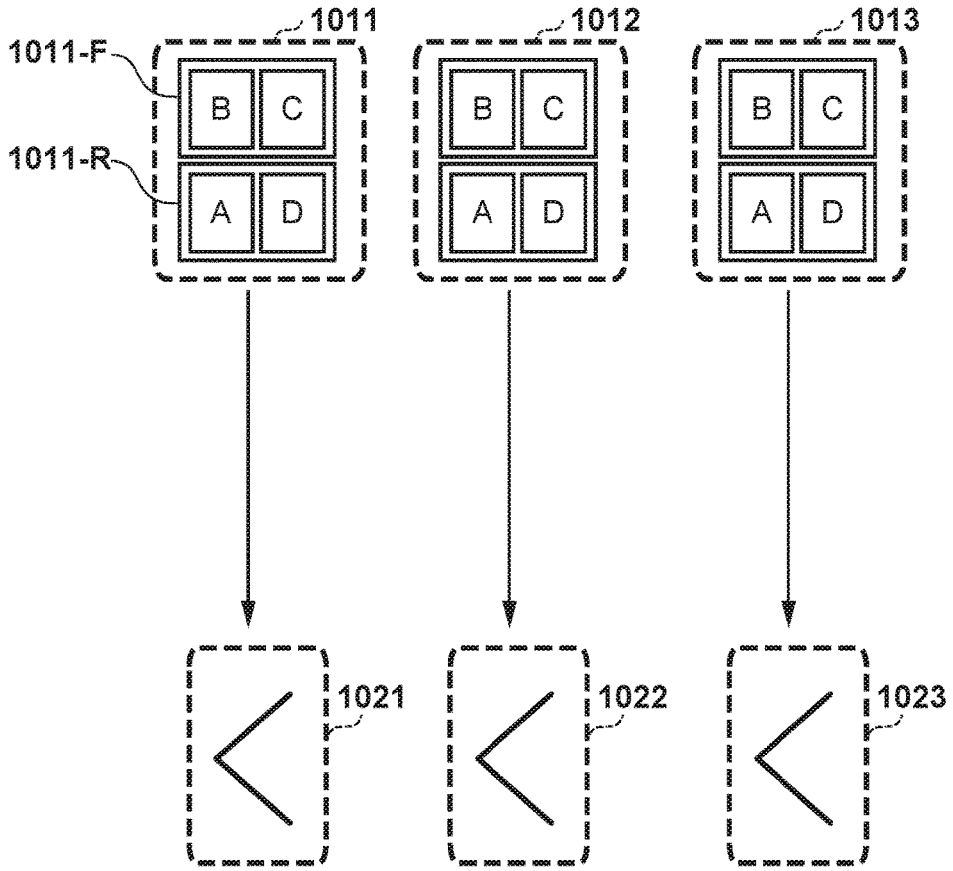

Next, for processing of a job where 3 copies of 4 originals are copied, and the finishing setting is "center-folding bookbinding", explanation is given with reference to FIGS. 10A and 10B.

FIGS. 10A and 10B depict views for explaining a state of the originals, the printed sheets, and after finishing when four originals are copied into 3 3 4-in-1 copies, and "center-folding bookbinding" finishing is executed.

The results of printing, 3 double-sided, 2-in-1 copies of 4 sheets of originals 1001 illustrated in FIG. 10A is illustrated by reference numerals 1011-1013. Furthermore, FIG. 10B illustrates the result of "center-folding bookbinding" finishing being performed on these sheets.

Here, for the imposition to the sheets, as is illustrated in reference numeral 1011, the originals are imposed in a bookbinding mode for a front surface and a back surface of the sheets so that when folding finishing is performed on the printed sheets, it becomes the bookbound page order. The 4 originals 1001 are laid out respectively such that the second page (B) and the third page (C) are on the front surface 1011-F of the sheet 1011, and the first page (A) and the fourth page (D) are on the back surface 1011-R of the sheet 1011, and the originals 1001 are output as printed sheets for which bookbinding imposition is performed. This imposition processing is performed similarly for a sheet 1012 of the second copy and a sheet 1013 of the third copy.

When the job illustrated in FIGS. 10A and 10B is started, it is determined not to be "non-bookbinding center-folding" in step S401 of FIG. 4, and the processing proceeds to step S601 of FIG. 6. In step S601 of FIG. 6, the sheet of the first copy is printed, it is discharged to the finishing apparatus 330 in step S602, and it is determined to be a separation of copies in step S603. With this the processing proceeds to step S605, and the CPU 111 controls the finishing apparatus 330 to execute "center-folding bookbinding". Next, the processing proceeds to step S606, the CPU 111 determines that it is not the final sheet of the job, the processing proceeds to step S602, and the second copy and the third copy are similarly processed.

By the foregoing processing, when "center-folding bookbinding" is executing, folding processing is executed at a separation of copies, and a finishing result 1021 of the first copy, a finishing result 1022 of the second copy, and a finishing result 1023 of the third copy are obtained, as shown in FIG. 10B.

As explained above, in accordance with this embodiment productivity can be improved in a case where the number of print sheets in 1 copy is 1 in setting for "non-bookbinding center-folding". Also, in a case in which there are multiple sheets in 1 copy where the separation of copies becomes important, it is possible to reduce the effort of a user for finding the separation between copies because the finishing processing is executed at the separation of copies.

Note that in the foregoing embodiment, explanation was given for an example in which the finishing apparatus 330, which is connected to the image forming apparatus 100, executes the folding processing having received sheets that are printed by the image forming apparatus 100, but the present invention is not limited to this. For example, it is possible to apply this to a case in which an operator carries sheets that are printed by a printing apparatus in accordance with a job to a finishing apparatus, and stacks them in a paper feed tray of the finishing apparatus or a paper feed stacker connected to the finishing apparatus, and then causes post processing (folding processing, or the like) to be executed on the sheet bundle. At that time, the operator inputs what conditions the job designated in the printing, that is the number of sheets configuring 1 copy, a print layout (page compiling, or the like), the existence/absence of double-sided printing, or the like, via a console unit (not shown), for example, to the finishing apparatus. With this, the finishing apparatus can obtain the number of sheets in 1 copy as in step S402 of FIG. 4 as described previously.

Also, cases in which the finishing apparatus 330 executes the processing illustrated in the flowcharts of FIGS. 4 through 6 are included in the present invention. In such cases, from the setting of the job and the number of originals for which step S402 is executed, the calculation of the number of sheets in 1 copy can be realized by receiving the setting information of the job from the image forming apparatus which is a printing apparatus.

Other Embodiments

Embodiment of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of the above-described embodiment and/or that includes one or more circuits (e. g., application specific integrated circuit (ASIC)) for performing the functions of the above-described embodiment, and by a method performed by the computer of the system or apparatus by, for example, reading out and executing the computer executable instructions from the storage medium to perform the functions of the above-described embodiment and/or controlling the one or more circuits to perform the functions of the above-described embodiment. The computer may comprise one or more processors (e. g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-031058, filed Feb. 19, 2015, which is hereby incorporated by reference herein in its entirety.

What is claimed is:

1. An image forming apparatus, comprising:

an operation unit configured to receive a user instruction to copy N copies of one or more originals, N being a positive integer equal to or greater than two;

a scanner unit configured to scan images on the one or more originals in accordance with the user instruction received by the operation unit, to generate image data;

an image forming unit configured to form images on a plurality of sheets based on the image data generated by the scanner unit;

a folding unit configured to perform center-folding processing on the plurality of sheets; and a control unit configured to determine a number of sheets per one copy of the plurality of sheets, based on a number of the originals scanned by the scanner unit, wherein the control unit is configured to control the folding unit to:

(i) if the number of sheets per one copy of the plurality of sheets is two or greater and less than a maximum number of sheets for folding capability of the folding unit, perform the center-folding processing for folding sheets, of the plurality of sheets, in units of the number of sheets per one copy, and (ii) if the number of sheets per one copy of the plurality of sheets is one, perform the center-folding processing for collectively folding sheets, of the plurality of sheets, in units of the maximum number.

2. The image forming apparatus according to claim 1, wherein the control unit is configured to control the folding unit to:

(iii) if the number of sheets per one copy is greater than the maximum number, perform the center-folding processing for folding sheets, of the plurality of sheets, in units of the maximum number or in units of the number of sheets per one copy.

3. The image forming apparatus according to claim 1, wherein the folding unit presses sheets to a nip to form a fold on the sheets.

4. The image forming apparatus according to claim 1, wherein the control unit determines the number of sheets per one copy based on the number of sheets read by the scanner unit and a setting of a single-sided printing or a double-sided printing.

5. The image forming apparatus according to claim 1, wherein the control unit determines the number of sheets per one copy based on the number of originals read by the scanner unit and a layout of the images formed by the image forming unit.

6. A method of controlling an image forming apparatus, the method comprising:

receiving a user instruction to copy N copies of one or more originals, N being a positive integer equal to or greater than two;

scanning, by a scanner unit, images on the one or more originals in accordance with the user instruction received in the receiving, to generate image data;

forming images on a plurality of sheets based on the image data generated by the scanner unit;

performing, by a folding unit, center-folding processing on the plurality of sheets;

determining a number of sheets per one copy of the plurality of sheets, based on a number of the originals scanned by the scanner unit;

controlling the center-folding processing such that, if the number of sheets per one copy of the plurality of sheets is two or greater and less than a maximum number of sheets for folding capability of the folding unit, perform the center-folding processing for folding sheets, of the plurality of sheets, in units of the number of sheets per one copy; and controlling the center-folding processing such that, if the number of sheets per one copy of the plurality of sheets is one, perform the center-folding processing for collectively folding sheets, of the plurality of sheets, in units of the maximum number.

7. A non-transitory computer-readable storage medium storing a program that causes a computer to perform a method for controlling an image forming apparatus, the method comprising:

receiving a user instruction to copy N copies of one or more originals, N being a positive integer equal to or greater than two;

scanning, by a scanner unit, images on the one or more originals in accordance with the user instruction received in the receiving, to generate image data;

forming images on a plurality of sheets based on the image data generated by the scanner unit;

performing, by a folding unit, center-folding processing on the plurality of sheets;

determining a number of sheets per one copy of the plurality of sheets, based on a number of the originals scanned by the scanner unit;

controlling the center-folding processing such that, if the number of sheets per one copy of the plurality of sheets is two or greater and less than a maximum number of sheets for folding capability of the folding unit, perform the center-folding processing for folding sheets, of the plurality of sheets, in units of the number of sheets per one copy, and controlling the center-folding processing such that, if the number of sheets per one copy of the plurality of sheets is one, perform the center-folding processing for collectively folding sheets, of the plurality of sheets, in units of the maximum number.

* * * * *